US005605364A

United States Patent [19]

Shelledy

[11] Patent Number: 5,605,364

[45] Date of Patent: Feb. 25, 1997

[54] DOORWAY SECURITY DEVICE AND METHOD OF USING SAME

[76] Inventor: Jack R. Shelledy, 510 W. Golfview, Blue Springs, Mo. 64014

[21] Appl. No.: 500,805

[22] Filed: Jul. 11, 1995

[51] Int. Cl.[6] ..... E05C 19/18

[52] U.S. Cl. ..... 292/259 R

[58] Field of Search ..... 292/259 R

[56] References Cited

U.S. PATENT DOCUMENTS

| | | | |
|---|---|---|---|
| 2,882,088 | 4/1959 | Black | 296/12 |
| 3,819,216 | 6/1974 | Richardson | 292/259 R |
| 4,014,571 | 3/1977 | Ellis | 292/300 |
| 4,082,332 | 4/1978 | Palmer | 292/259 R |
| 4,429,911 | 2/1984 | O'Neal et al. | 292/259 R |
| 4,667,992 | 5/1987 | Roden, Jr. | 292/259 R |
| 4,772,055 | 9/1988 | Fang | 292/337 |
| 4,779,910 | 10/1988 | Dameron | 292/259 R |
| 5,077,940 | 1/1992 | LaRose, Jr. | 292/259 R |
| 5,232,254 | 8/1993 | Teaff | 292/259 R |
| 5,253,905 | 10/1993 | Hutson | 292/92 |
| 5,282,656 | 2/1994 | Fizer | 292/259 R |
| 5,291,760 | 3/1994 | Schrader | 70/14 |
| 5,340,172 | 8/1994 | Sweet | 292/259 R |
| 5,364,140 | 11/1994 | Rice | 292/259 R |
| 5,398,982 | 3/1995 | Watson, Jr. | 292/259 R |

OTHER PUBLICATIONS

Phoenix Defender Series 10–40, Sep. 6, 1983.

*Primary Examiner*—Rodney M. Lindsey
*Attorney, Agent, or Firm*—David G. Rosenbaum

[57] ABSTRACT

A barricade to prevent a door from being opened and entry gained by an unauthorized or unwanted person. The doorway security barricade apparatus removably attaches to a door frame and includes a bar which extends across the doorway, bar brackets which attach to the bar, mounting brackets which are attached to the wall and the door frame and receive the bar brackets to mount the security apparatus across the door, and an assembly coupled to the bar which allows a user to apply a positive pressure to the door and restrict movement of the door latch or deadbolt within the door jamb, prevent opening of the door, and restrain against extraordinary external forces applied against an exterior surface of the door.

19 Claims, 2 Drawing Sheets

DOORWAY SECURITY DEVICE AND METHOD OF USING SAME

BACKGROUND OF THE INVENTION

The present invention relates generally to security devices which act as a physical barrier against unauthorized entry through an entryway. More particularly, the present invention relates to devices which act as restraining barricades to prevent a door from being opened and entry gained by an unauthorized or unwanted person.

Concern for the safety of one's person, residence or business property is an unfortunate fact of daily life. A myriad of apparatus and devices have been devised to increase personal safety as well as the safety of residences and business premises against unauthorized access and intrusion. The present invention is particularly well-suited to assist the homeowner, renter or business owner in securing entry doorways against unauthorized intrusion.

Various types of doorway security devices are known. Such types of doorway security devices include mechanical apparatus such as deadbolt locks, deadbolt latch locks, locking hasps, sliding pins which engage locking recesses, door handle wedge bars, hinge locks and barrier bars, and electronic devices such as electromagnetic switches and infrared sensors. The following patents are representative of types of mechanical apparatus:

The Palmer patent, U.S. Pat. No. 4,082,332, issued in 1978, discloses a security apparatus which comprises a rigid bar and a pair of brackets. A hollow cylinder of resilient foam material surrounds the bar over a short length. The cylinder is positioned to overlie the doorknob side of the door, thus cushioning the shock of the door being forcibly opened. The end of the bar is inserted into and through the closed loop of one bracket and between the inner portion and flange of the J-shaped bracket. The bar may be hung from one of the brackets in a non-operative position by inserting an extension on the bar into an aperture in the bracket.

The O'Neal, et al. patent, U.S. Pat. No. 4,429,911, issued in 1984, discloses a security door bar system in which a rigid bar extends in front of a door between a pair of mounting brackets. One bracket has an elongated slot and the other has a T-shaped slot. The opposite ends of the bar have a reduced diameter and a flange, allowing the bar to axially penetrate, and be restrained by and between, the bracket members.

The Fizer patent, U.S. Pat. No. 5,282,656, issued in 1994, discloses a door security bar system which comprises an adjustable cylinder bar with a self-contained hinge on one end for rotating the bar to the storage position and a locking pin on the other end which restrains the bar when it is in security position. A closed-ended bracket, with an indentation for holding the locking pin, holds the bar in security position and a catcher holds the bar in the storage position. The third bracket allows the bar to rotate. This security bar extends across the width of the door, but does not extend beyond the door molding, as in your device. The brackets do not include pintles or coaxial cylindrical members and the bar does not include an adjustment knob.

The Dameron patent, U.S. Pat. No. 4,779,910, issued in 1988, discloses a self-releasing security bar which device includes a telescoping bar with opposite ends engaging wall brackets. Aligned transverse holes in the bar allow a release pin to maintain the bar in its extended length. When the release pin is pulled, a spring pulls the bar sections to a shorter overall length, permitting the bar to fall away from the mounting brackets.

The Sweet patent, U.S. Pat. No. 5,340,172, issued in 1994, discloses a door security system for use on both inward and outward opening doors. This system includes an elongated telescoping bar that engages both door knobs and docking ferrules incorporated into the opposing door hinges. Door jamb mounting brackets are used for outward opening double doors.

The Hutson patent, U.S. Pat. No. 5,253,905, issued in 1993, discloses a door locking system which engages the door frame on an outwardly opening door and includes a panic bar which moves towards the door for disengaging the locking system. An outer sleeve fixedly mounts to the interior surface of the door and an inner sleeve pulls against a spring to a door frame engagement position.

The Rice patent, U.S. Pat. No. 5,364,140, issued in 1994, discloses a door security device which includes a security bar extending across the surface of the door, opposing blocking members resting against the door frame and an attachment mechanism including J-shaped hooks which engage a portion of the door.

The Teaff patent, U.S. Pat. No. 5,232,254, issued in 1993, discloses a door securing device which consists of a first bracket with a slot and a second hinged bracket with a slot mounted outside the door jambs. The second latch includes a slit which extends around an outwardly extending receiving latch. A security bar, with stops on both ends, extends across the surface of the door and the door jambs and engages the brackets.

The Watson, Jr. patent, U.S. Pat. No. 5,398,982, issued in 1995, discloses a door security bar consisting of an elongated rod with an arcuate handle end. The handle end has a downward extension which is rotatable within a ferrule bar sleeve portion mounted adjacent to the door. The elongated rod is insertable within the floor adjacent to the door.

The Black patent, U.S. Pat. No. 2,882,088, issued in 1959, discloses pin-like connectors for removable cattle racks for vehicles. This patent discloses a hook and eye type connector. An elongated tongue projects forwardly from the body of the hook. A vertical shank extends from the tongue and terminates in a long tapered pin. A bore extends through the body of the hook, allowing the pin to mate with the body of the hook.

The Ellis patent, U.S. Pat. No. 4,014,571, issued in 1977, discloses a locking means for doors and windows. The device consists of a pair of plates. One of the plates is mounted on the back of the door proximate each hinge and the other plate is mounted on the jamb with its angled end portion projecting behind the angled end portion of the plate.

The Schrader patent, U.S. Pat. No. 5,291,760, issued in 1994, discloses a portable lock for doors. The lock consists of a unitary plate, attached to the inner side of a door, with a clamping and locking mechanism. The clamping mechanism is a wing nut and the locking mechanism is a lock cylinder and an opening for insertion of a peg.

Conventional doorways consist primarily of doors which are mounted on hinges to a door jamb. The door jamb is, in turn, mounted into a structural opening in a wall. It is well known in the construction field that when building a wall which is to have a door, an opening is created by framing a door opening of the same structural support material used to make the wall. For example, in typical home construction, interior walls are made of generally horizontally oriented header and toe members and vertical studs, all typically made from wood "two-by-fours" having a nominal transverse cross-sectional dimension of 1½ inches by 3½ inches. Door openings in wood framed walls are typically made by framing the lateral aspects of the door opening using two or three "two-by-four" studs positioned adjacent and attached to one another so that their largest lateral dimensions are in abutting relationship. The upper aspect of the door opening is also created by cutting two or three "two-by-fours" to the desired width of the door opening, attaching them to one another so that their largest lateral dimensions are in abutting relationship, thereby creating a door header assembly and then attaching the door header assembly to each of the lateral aspects of the door opening. Front and rear entry-way door openings are typically 32 inches or 36 inches in width. The rough framing for the door opening, consisting of the wall studs and cripple studs, typically extends four inches on each lateral side of the door opening, thereby adding a total of eight inches to the total door frame width. Thus, a 36 inch door opening has rough framing which extends 44 inches in width, while a 32 inch door opening has rough framing which extends 40 inches in width. The door opening is known in the art as the door frame. Once the framed wall having the door frame therein is in place, a wall surface is typically applied over the wall. Typical wall surfaces are drywall sheets made of compressed plaster or concrete having paper or paperboard planar front and back surfaces. The drywall sheets, having a typical wall thickness of ½ inch, are applied to the framed wall and attached to the wall studs using nails or screws.

After the drywall is secured to the wall, a door mounted on hinges in a door jamb may be mounted into the door frame and secured therein using nails or screws. Door trim pieces are then applied around the perimeter of the door frame to cover any opening between the door jamb and the door frame. The door trim is largely esthetic in nature and is non-structural, but typically covers up to 1½ inches of the rough door frame around its perimeter. Thus, approximately 2½ inches of door frame remain in which to secure a mounting bracket to retain a security device in a strong fixed position in the door frame studs.

Virtually anyone familiar with hinged doors understands that hinged doors open by pivoting on hinges through an arc typically from 0°, where 0° represents the door in its closed position coplanar with the wall, to greater than 90° to permit passage through the doorway.

Virtually all of the conventional barricade-type doorway security devices permit the door to open a small distance, for example less than 15° relative to the wall, to permit visual identification of persons outside the doorway. Because many unauthorized intrusions occur because extraordinary forces are applied to the door, such as by kicking, prying, ramming, etc., any small opening in the door provides increased opportunity for the unwanted intruder to access the door hinges or break the door off of its hinges and obtain unauthorized entry.

It has been found desirable, therefore, to provide a doorway security barricade apparatus which removably attaches to the door frame and which includes a means to apply a positive pressure to the door and restricts movement of the door latch or deadbolt within the door jamb, prevents opening of the door, and restrains against extraordinary external forces applied against an exterior surface of the door.

SUMMARY OF THE INVENTION

It is a principal objective of the present invention to provide an apparatus for securing a doorway against undesired intrusion which employs a security bar removably mountable across a doorway and which has a means for applying a positive pressure against the door to restrict movement of the door within the door jamb and the door frame.

Another objective of the present invention is to provide a doorway security apparatus which includes door frame mounting brackets, a security bar having bar brackets positioned at opposing longitudinal aspects of the security bar which are removably engageable with the mounting brackets and a manually adjustable abutment for applying a positive pressure to an interior surface of the door which acts directly upon the security bar to prevent any opening of the door.

It is another objective of the present invention to provide mounting brackets which have a rear mounting plate and at least two forwardly projecting tubular cylinders superimposed in vertical coaxial alignment relative to one another.

It is still another objective of the present invention to provide bar brackets with mounting pins which are removably engageble into the at least two forwardly projecting tubular cylinders and a bar receiving opening passing through the bar bracket to receive the security bar member therethrough.

It is yet another objective of the present invention to provide a bar bracket having a transverse opening passing laterally through the bar bracket and bounded with a mounting flange for adjustably positioning the bar bracket at a point along the longitudinal axis of the bar member.

It is still another objective of the present invention to provide a doorway security device which provides a manually adjustable means for exerting a positive pressure on an inner planar surface of a door and on the bar member.

These and other objects, features and advantages of the present invention will be more apparent to those skilled in the art from the following more detailed description of the preferred embodiments of the present invention taken with reference to the accompanying figures in which like elements are identified by like reference numerals.

DETAILED DESCRIPTION OF THE PREFERRED EMBODIMENTS

Figure 1:
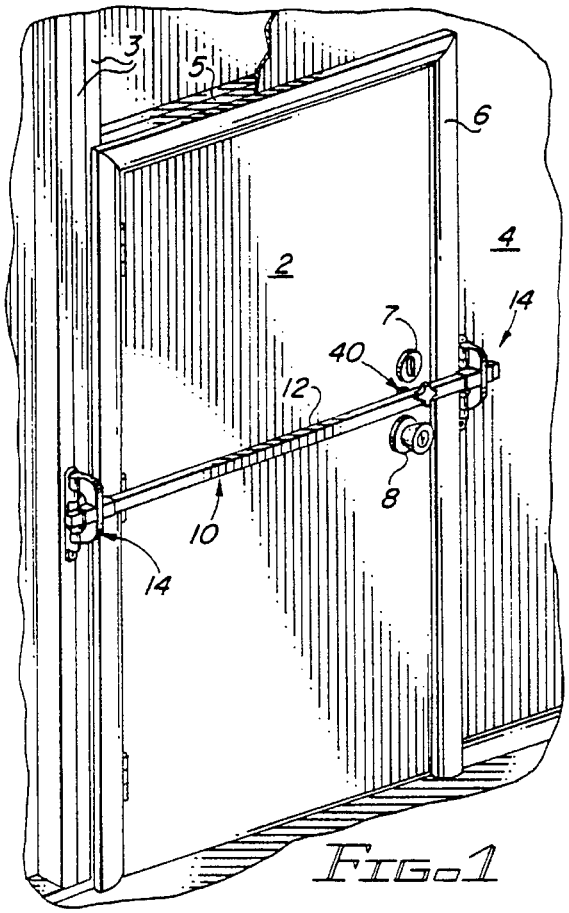
FIG. 1 is a perspective view of a doorway illustrating the inventive security bar apparatus mounted across the doorway.

FIG. 1 illustrates the doorway security apparatus 10 mounted across a doorway in accordance with the present invention. Those skilled in the art will understand that doorways are typically constructed by rough framing a door opening using a plurality of vertical wall studs 3 abutting one another to form lateral aspects of the doorway and a cripple stud 5 attached between the lateral aspects of the doorway and forming an upper aspect of the doorway. A door 2 mounted onto a door jamb (not shown) using hinges is mounted in the door frame and affixed therewithin. A wall covering 4, such as drywall, is placed over the wall studs 3 and cripple stud 5 and affixed thereto in a conventional manner. Door trim 6 is then applied around the perimeter of the door opening to provide an esthetic covering for any openings between the door jamb and the door fame. Entry doorways, such as front and rear doors, typically have a door knob 8 and a deadbolt latch 7 to provide for closure and locking of the door, respectively, in its closed position within the door jamb.

The inventive doorway security apparatus 10 is mounted such that it extends across the doorway opening and interferes with and impedes against forcible opening of the door.

Figures 2, 7, 8, 9, 10, 11, 12:
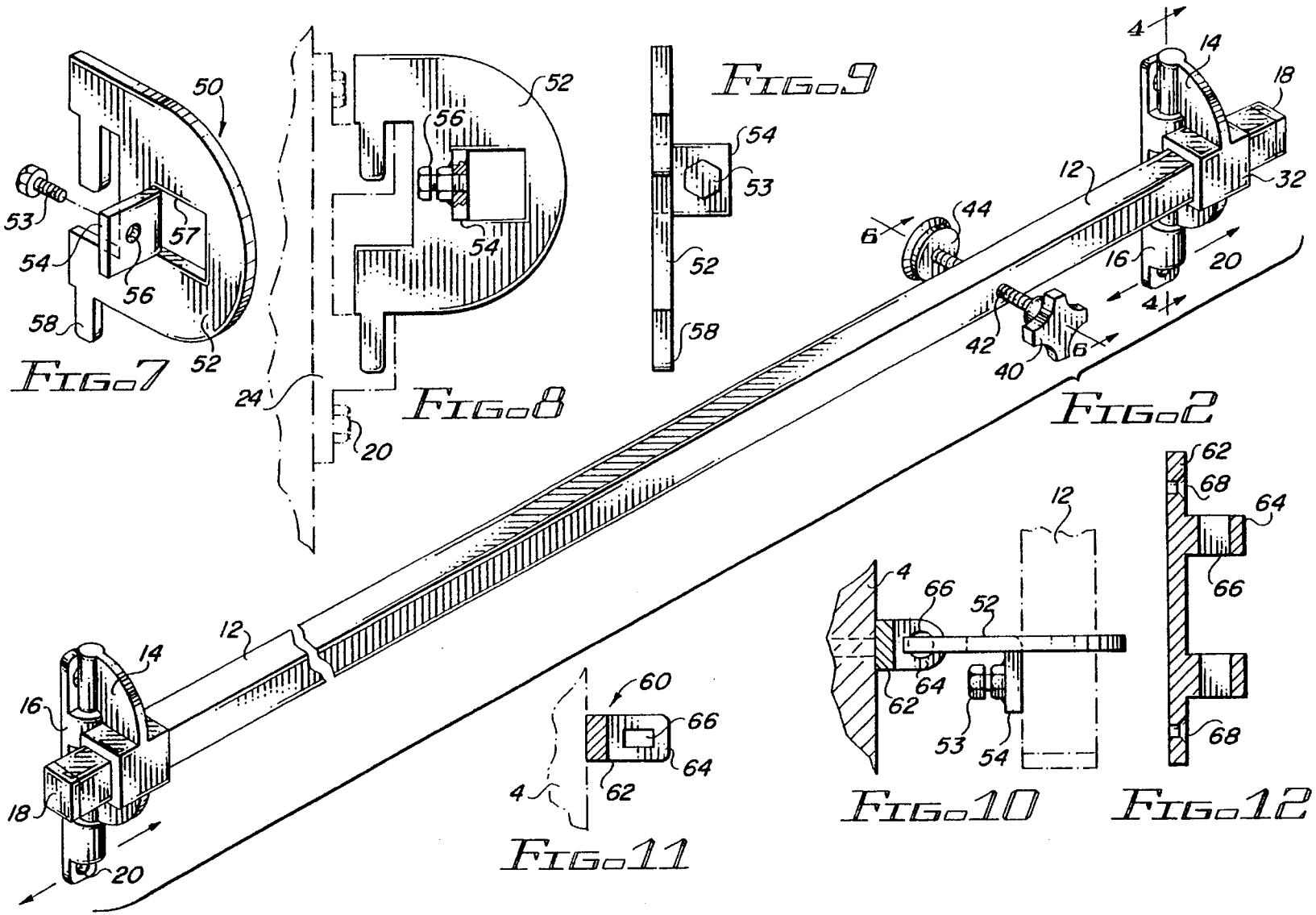
FIG. 2 is a fragmentary perspective view of the security bar apparatus in accordance with the present invention.
FIG. 7 is a perspective partial exploded view of a second preferred embodiment of the bar bracket in accordance with the present invention.
FIG. 8 is a side elevational view of the second embodiment of the bar bracket illustrating its engagement with a mounting bracket shown in phantom.
FIG. 9 is an end elevational view of the second embodiment of the bar bracket in accordance with the present invention.
FIG. 10 is a top elevational view illustrating engagement of the second embodiment of the security bar member, the second embodiment of the bar bracket and the mounting bracket, in accordance with the present invention.
FIG. 11 is a top elevational view of a second embodiment of the mounting bracket in accordance with the present invention.
FIG. 12 is cross-sectional view of a mounting bracket in accordance with the present invention.

As illustrated in FIG. 2, the inventive doorway security apparatus 10 consists generally of a bar member 12, at least two bar bracket members 14, at least two mounting bracket members 16 and a manually adjustable abutment assembly 40. The bar member 12 is preferably made of an elongate tubular or solid member having high tensile strength and a low degree of brittleness. Suitable materials are metals, such as steel, aluminum or titanium, plastics having a high degree of rigidity and low degree of brittleness and frangibility, or hardwoods, such as ash or oak. It is preferable, but not required, that the bar member 12 have a generally square transverse cross-sectional shape to facilitate a substantially non-torsional engagement between the bar bracket members 14 and the bar member 12. The bar member may be fitted with end caps 18 attached to opposing ends of the bar member 12. The use of end caps 18 is particularly advantageous where the bar member 12 is made of a hollow tubular material.

Figure 4:
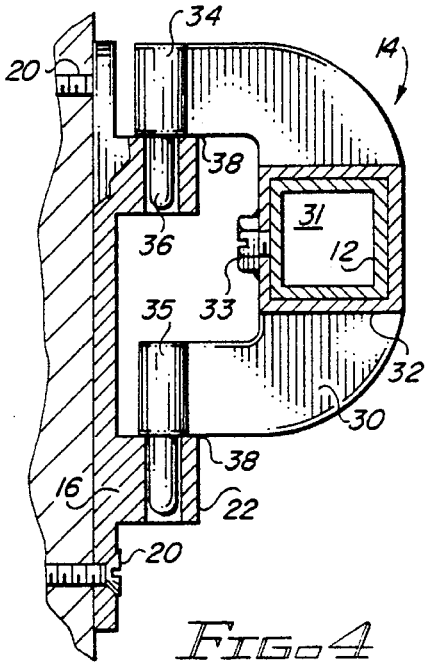
FIG. 4 is a cross-sectional view taken along line 4—4 of FIG. 2.
Figure 5:
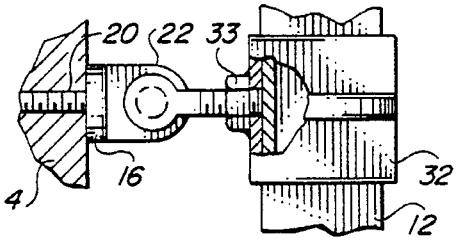
FIG. 5 is a top elevational, partial cross-sectional view illustrating engagement of the security bar, mounting bracket, and bar bracket in accordance with a first preferred embodiment of the present invention.
Figure 3:
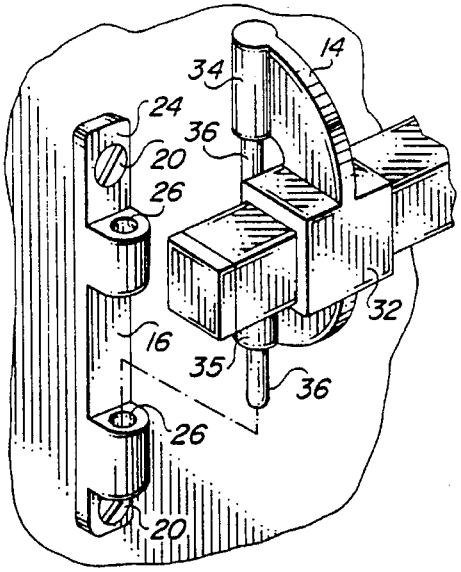
FIG. 3 is an exploded perspective view of a bar bracket and mounting bracket in accordance with a first preferred embodiment of the present invention.

The mounting bracket members 16 are attached to the door frame studs 3 on lateral sides of the doorway by the use of wood screws 20. To optimize a secure attachment between the mounting bracket members 16 and the doorway it is important that the screws 20 be of sufficient length to pass through openings in the mounting bracket members 16, through the wall covering 4 and into the door frame studs 3. Screws 20 are preferably, therefore, at least 2½ inches in length. As illustrated in FIGS. 3 to 5, the mounting bracket members 16 removably couple with the bar bracket members 14 which are, in turn, attached to the bar member 12.

With particular reference to FIGS. 3, 4 and 5, it is seen that mounting brackets 16 consist generally of an elongate mounting back plate having two forwardly projecting cylindrical ferrule members 22 attached thereto. The ferrules 22 are vertically aligned and have co-axially aligned pin receiving bores 26 passing through a substantial longitudinal extend of the ferrule member 22. As noted above, mounting brackets 16 are attached to lateral sides of the doorway by screws 20. It is preferable that mounting brackets 16 be attached to the doorway such that the longitudinal axis of the mounting brackets 16 is substantially parallel to the vertical extent of the doorway with the mounting brackets being attached by driving the screws 20 into a single wall stud 3.

The bar bracket members 14 preferably consist of a generally planar body 30 having either a generally C-shape or a generally D-shape, depending upon the observer's view orientation of the planar body 30. The generally planar body 30 further includes upper 34 and lower 35 leg portions which are in vertical co-axial alignment with one another. Mounting pins 36 depend from each of the upper 34 and lower 35 leg portions of planar body 30. Mounting pins 36 may be attached to the upper 34 and lower 35 leg portions by appropriate means, such as welding, or may be integrally formed with the upper 34 and lower 35 leg portions during manufacture of the bar bracket member 14, such as by casting, molding or machining. Mounting pins 36 are preferably cylindrical in shape and have a outer diameter which approximates the inner diameter of ferrule members 22 such that each mounting pin 36 may be received within a corresponding ferrule member 22 within close tolerance. Mounting pins 36 and pin receiving bores 26 may, alternatively, have other cross-sectional shapes, such as a generally quadrilateral cross-sectional shape as illustrated in the alternative embodiments illustrated in FIGS. 7–12.

Those skilled in the art will appreciate that it is preferable to provide a pin seat 38 at a juncture position between the mounting pin 36 and the corresponding upper 34 or lower 35 leg portion of the planar body 30. Pin seat 34 may be formed by an enlarged section of the upper 34 or lower 35 leg portion which acts as a seating in abutment with ferrule member 22.

Each bar bracket member 14 further includes an opening passing through the planar body 30 perpendicular to the plane of the planar body 30. The opening is preferably bounded by a mounting bracket collar 32 having an associated position setting member 33. Position setting member 33 is preferably a threaded member, such as an Allen head screw or machine bolt, which is screwedly engaged within a threaded opening passing through the mounting bracket collar 32 and permits the position setting member 33 to impinge upon the bar member 12, thereby frictionally retaining the mounting bracket member 14 in a desired position along the longitudinal axis of the bar member 12. The mounting bracket collar 32 may extend about an entire transverse circumferential section of the bar bracket member 12 as illustrated in FIGS. 3 and 4, or may consist of a flange member 54 illustrated in FIG. 7 which will be described in greater detail hereinafter.

Figure 6:
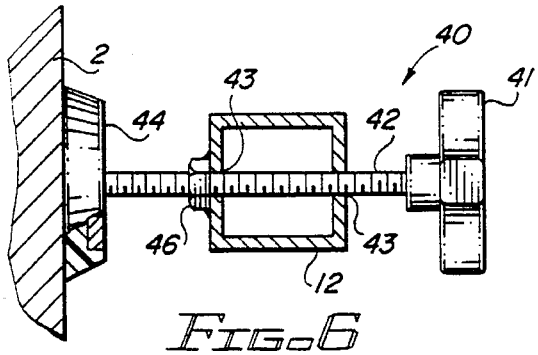
FIG. 6 is a cross-sectional view taken along line 6—6 of FIG. 2.

The manually adjustable abutment assembly 40 represents a significant improvement over conventional doorway security devices. As illustrated in FIG. 6, the manually adjustable abutment assembly 40 consists generally of a threaded member 42, a handle member 41 residing on one end thereof and a door plate member 44 residing on an opposite end of the threaded member 42. The threaded member 43 passes transversely through a pair of coaxially aligned openings 43 on opposing surfaces of the bar member 12. The manually adjustable abutment assembly 40 has a longitudinal axis which is substantially perpendicular to the longitudinal axis of the bar member 12 and substantially perpendicular to an interior planar surface of the door 2. Coaxially aligned openings 43 may themselves be threaded to adjustably receive threaded member 42 therein, or may have a threaded retaining member 46 operably associated therewith to adjustably retain and receive threaded member 2 therethrough. The door plate member 44 is a generally disc-shaped member having a planar surface for abutting against an inner planar surface of door 2. In use, after the bar member 12 has been positioned across a doorway by engagement of the bar bracket members 14 with the mounting bracket members 16, the door plate member 44 is positioned against the interior planar surface of door 2 by screwedly adjusting the threaded member 42 using by applying a torsional pressure to handle 41, thereby causing the door plate member 44 to abut against door 2. It is preferably that a small degree of pressure be exerted by the door plate member 44 against door 2 to cause the door 2 to become substantially immovable within the door jamb.

An alternative preferred embodiment of the bar bracket members 14 and mounting bracket members 16 is illustrated in FIGS. 7–12. FIGS. 7–9 illustrate an alternative embodiment of a bar bracket member 50. Bar bracket member 50 is designed for single-piece fabrication and eliminates the need for joining of multiple pieces. Bar bracket member 50 consists of a generally C-shaped or D-shaped planar body 52, depending upon the view orientation of the observer, having upper and lower leg portions 55 extending outwardly from planar body 52. Mounting pins 58 project downwardly from each of the upper and lower leg portions 55 of planar body 52. A bar receiving opening 57 passes transversely through the planar body 52 and forms an opening through which the bar member 12 (not shown) may pass. A flange member 54 projects perpendicular to the plane of the planar body 52 and resides adjacent one lateral edge of bar receiving opening 57. When the bar member 12 (not shown) passes through bar receiving opening 57, the flange member 54 is parallel to the longitudinal axis of the bar member 12 and positioned adjacent the bar member 12. Flange member 54 is preferably made by die stamping a three-sided section of the planar body 52, then impact extruding the flange member 54 by application of pressure against the stamped section to cause flange member 54 to be deformed perpendicular to the plane of planar body 52.

An opening 56 passes through flange member 54 in a direction substantially parallel to the plane of planar body 52 to accommodate a lock screw member 53 therethrough. Lock screw member 53 is preferably an Allen screw, but may also be a machine screw. Opening 56 may be threaded to receive lock screw member 53 therethrough or may have an associated retaining nut as with bar bracket member 14. As with bar bracket member 14, after the bar bracket member 50 is positioned along the longitudinal axis of bar member 12, a user manually adjusts lock screw member 53 to impinge upon bar member 12, thereby frictionally retaining bar bracket member 50 in a fixed position along the longitudinal axis of bar member 12.

Mounting pins 58 may have any desired cross-sectional shape. As illustrated in FIGS. 1–6, mounting pins 36 have a generally circular cross-sectional shape and mate with ferrules 22 with pin receiving bores 26 which have a corresponding generally circular cross-sectional shape. As illustrated in FIGS. 7–12, mounting pins 58 have a generally quadrilateral shaped cross-sectional shape and the mounting bracket 60 has mounting ferrules 64 with pin receiving bores 66 having either a corresponding generally quadrilateral cross-sectional shape illustrated in FIG. 11, or a generally circular cross-sectional shape, illustrated in FIG. 10. Mounting brackets 60 are constructed similarly to mounting brackets 16 having mounting plate 62 having a plurality of attachment openings 68 which receive mounting screws or bolts therethrough to affix the mounting bracket 60 through drywall 4 to the door frame studs (not shown), and a plurality of vertically co-axially aligned mounting ferrules 64, each having pin receiving bores 66 passing therethrough.

Those skilled in the art will understand that the cross-sectional shape of the mounting pins 36 or 58 and the cross-sectional shape of the pin receiving bores 26 or 66 on mounting brackets 62 may be selected based upon manufacturing considerations, including whether the bar brackets 14 or 50 are made of multi-piece assembled construction where the individual components of the bar brackets 14 are fabricated and then assembled, or of unitary, integral construction, where the planar body 52, including upper and lower leg portions, mounting pins 58, flange 54 and opening 57 are made as a single component, such as by casting, molding or die stamping.

While the present invention has been described with reference to its preferred embodiments, those skilled in the art will understand that various changes, modifications and alterations may be made to the shape, configuration, materials selection, design, and method of manufacture which still fall within the spirit and scope of the present invention which is limited only by the following claims.

What is claimed is:

1. A doorway security apparatus, comprising in combination:

a bar member;

at least two bar bracket members coupled to and moveable along a longitudinal axis of said bar member;

at least two mounting members, each of said mounting members being secured to lateral aspects of a doorway and having receiving means for removably coupling one of said at least two bar bracket members such that said bar member extends across a doorway thereby impeding full opening of a door; and manually adjustable abutment means passing transversely through said bar member and extending outwardly from front and rear aspects thereof, said manually adjustable abutment means being for manually applying a positive pressure to a planar surface of a door.

2. The doorway security apparatus of claim 1, wherein said bar member further comprises a unitary integral bar member having a generally quadrilateral cross-sectional shape.

3. A doorway security apparatus, comprising in combination:

a bar member;

at least two bar bracket members coupled to and moveable along a longitudinal axis of said bar member:

at least two mounting members each of said mounting members being secured to lateral aspects of a doorway and having receiving means for removably coupling one of said at least two bar bracket members such that said bar member extends across a doorway thereby impeding full opening of a door wherein said at least two bar bracket members each comprise a generally C-shaped planar member having an upper and a lower leg portion thereof and a transverse opening passing therethrough, said transverse opening being sized to receive said bar member therethrough, and coupling means projecting downwardly from each of said upper and said lower leg portions of said generally C-shaped planar member, said coupling means being removably engageable with one of said at least two mounting members.

4. The doorway security apparatus of claim 3, wherein said mounting bracket members each comprise a mounting plate having openings passing therethrough which receive threaded-members to secure said mounting plate to the doorway and at least two generally vertically and co-axially aligned tubular members projecting forwardly from said mounting plate.

5. The doorway security apparatus of claim 3, wherein said transverse opening of said generally C-shaped planar member further comprises a generally tubular collar member.

6. The doorway security apparatus of claim 3, wherein said bar member further comprises a unitary integral bar member having a generally quadrilateral cross-sectional shape and said tubular collar member has a generally quadrilateral cross-sectional shape and is sized to received said unitary integral bar member therethrough.

7. The doorway security apparatus of claim 6, wherein said tubular collar member further comprises an opening passing therethrough and a lock screw engaged through said opening passing through said tubular collar member, said lock screw being impingable upon said bar member to retain said bar bracket member in a selected position along the longitudinal axis of said bar member.

8. The doorway security apparatus of claim 3, wherein said transverse opening further comprises a flange member extending substantially perpendicular to said generally C-shaped planar member adjacent said transverse opening.

9. The doorway security apparatus of claim 8, wherein said flange member further comprises a cut-out section of said generally C-shaped planar member deformed to said substantially perpendicular position relative to said generally C-shaped planar member.

10. The doorway security apparatus of claim 8, wherein said flange member further comprises a threaded opening passing through said flange member and said doorway security apparatus further comprises a lock screw engaged with said threaded opening in said flange member.

11. The doorway security apparatus of claim 3, wherein said coupling means on each of said at least two bar bracket members further comprise pin members.

12. A security apparatus for use in association with a hinged one-way opening door, comprising in combination:

a barricade member having a longitudinal length sufficient to extend across the door;

at least two bracket members coupled to and moveable along a longitudinal axis of said barricade member, each of said at least two bracket members having generally D-shaped planar lateral surfaces, a curved surface facing generally outwardly with respect to the door, and upper and lower portions facing generally inward with respect to the door;

coupling members attached to and depending from each of said upper and lower portions of each of said at least two bracket members;

at least two mounting members, each of said mounting members being secured to lateral aspects of a door frame defining a perimeter of the door, and having receiving means for removably coupling to said coupling members of each of said at least two bracket members; and manually adjustable abutment means passing transversely through said barricade member and extending outwardly from front and rear aspects thereof, said manually adjustable abutment means being for manually applying a positive pressure to an inward planar surface of the door;

whereby when said bracket members are engaged with said at least two mounting members, said barricade member extends across a doorway thereby impeding full opening of a door.

13. The security apparatus of claim 12, wherein said at least two bracket members further comprise a transverse opening passing through said D-shaped planar surfaces, said transverse opening being sized to receive said barricade member therethrough.

14. The security apparatus of claim 13, wherein said transverse opening comprises a generally tubular collar member.

15. The security apparatus of claim 13, wherein said barricade member further comprises a unitary integral bar member having a generally quadrilateral cross-sectional shape and said tubular collar member has a generally quadrilateral cross-sectional shape and is sized to received said unitary integral barricade member therethrough.

16. The security apparatus of claim 15, wherein said tubular collar member further comprises an opening passing therethrough and a lock screw engaged through said opening passing through said tubular collar member, said lock screw being impingable upon said bar member to retain said bracket member in a selected position along the longitudinal axis of said barricade member.

17. The security apparatus of claim 13, wherein said transverse opening further comprises a flange member extending substantially perpendicular D-shaped planar surfaces of said bracket member adjacent said transverse opening.

18. The doorway security apparatus of claim 17, wherein said flange member further comprises a cut-out section of said generally bracket member deformed to said substantially perpendicular position relative to said generally D-shaped planar surfaces of said bracket member.

19. The doorway security apparatus of claim 17, wherein said flange member further comprises a threaded opening passing through said flange member and said doorway security apparatus further comprises a lock screw engaged with said threaded opening in said flange member.

* * * * *